United States Patent [19]

Thomasson

[11] Patent Number: 5,012,597

[45] Date of Patent: May 7, 1991

[54] SHOE SOLE WITH TWIST FLEX FEATURE

[76] Inventor: Robert Thomasson, 20200 - 87th Ave. S., Kent, Wash. 98032

[21] Appl. No.: 343,429

[22] Filed: Apr. 26, 1989

[51] Int. Cl.[5] ..... A43B 5/00

[52] U.S. Cl. ..... 36/59 C; 36/59 R; 36/114

[58] Field of Search ..... 36/59 R, 59 C, 114, 36/32 R, 102

[56] References Cited

U.S. PATENT DOCUMENTS

| | | | |
|---|---|---|---|
| 2,162,912 | 6/1939 | Craver | 36/59 C |
| 3,680,231 | 8/1972 | Dymond | 36/59 R |
| 4,151,661 | 5/1979 | Namba et al. | 36/32 R |
| 4,562,651 | 1/1986 | Frederick et al. | 36/59 C |
| 4,624,062 | 11/1986 | Autry | 36/32 R |
| 4,724,624 | 2/1988 | Duccos | 36/59 C |
| 4,747,220 | 5/1988 | Autry et al. | 36/59 C |
| 4,760,652 | 8/1988 | Austin | 36/59 C |
| 4,783,910 | 11/1988 | Boys, II et al. | 36/107 |
| 4,890,398 | 2/1990 | Thomasson | 36/59 C |
| 4,897,936 | 2/1990 | Fuerst | 36/32 R |

FOREIGN PATENT DOCUMENTS

| | | | |
|---|---|---|---|
| 2113143 | 10/1972 | Fed. Rep. of Germany | 36/32 R |
| 2458576 | 6/1976 | Fed. Rep. of Germany | 36/59 C |
| 3024587 | 1/1982 | Fed. Rep. of Germany | 36/59 C |
| 1018202 | 12/1952 | France | 36/59 R |
| 473286 | 10/1937 | United Kingdom | 36/59 C |

*Primary Examiner*—Steven N. Meyers

*Attorney, Agent, or Firm*—Delbert J. Barnard; Bruce A. Kaser

[57] ABSTRACT

An athletic shoe sole (10) includes a twist flex portion (18) positioned generally below the ball region of the user's foot. The twist flex portion (18) is defined by intersecting diagonal grooves (20, 22, 24, 26) and diamond shaped cleats (44, 46) between the grooves. A truncated pivot ball (28) is located in a toe portion (12) of the shoe. A similar pivot ball (38) is located in the heel portion (16) of the shoe. Grooves and ribs are provided in several regions of the shoe sole (10) for facilitating flexing of the shoe sole (10) in a direction perpendicular to the ribs and grooves, and for stiffening the shoe sole (10) in a direction longitudinally of the ribs and grooves.

13 Claims, 2 Drawing Sheets

Fig. 2
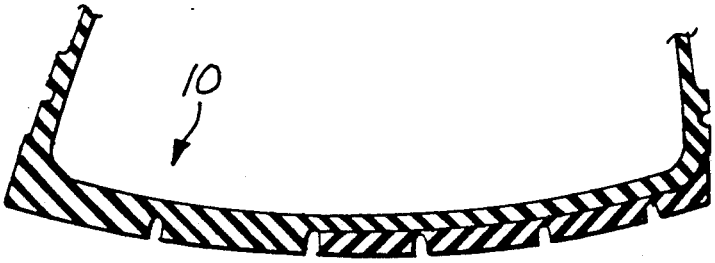
Fig. 3
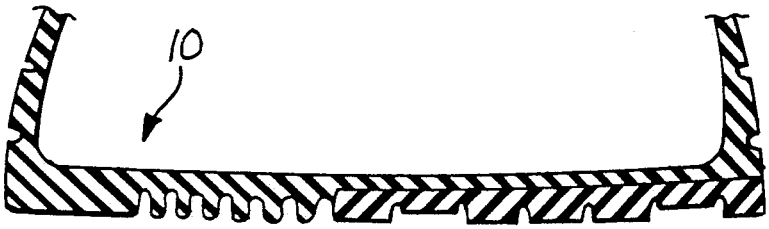
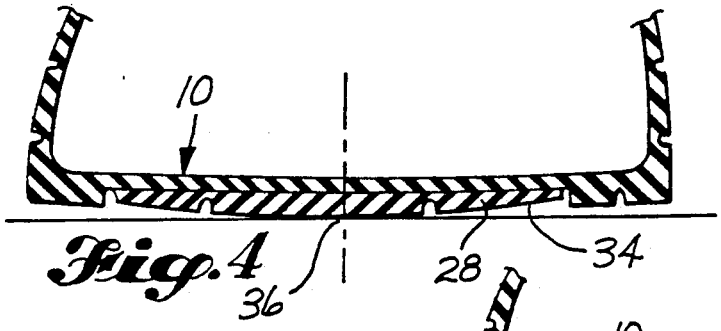
Fig. 4
Fig. 5
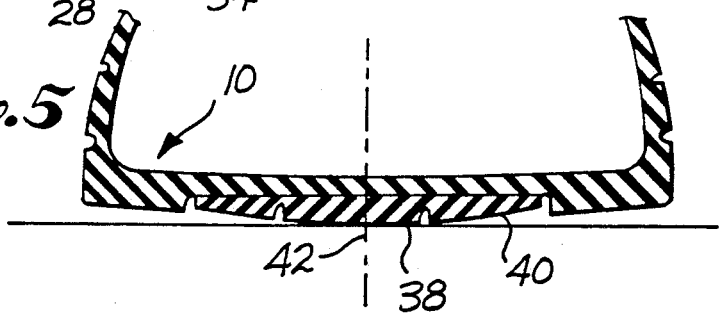
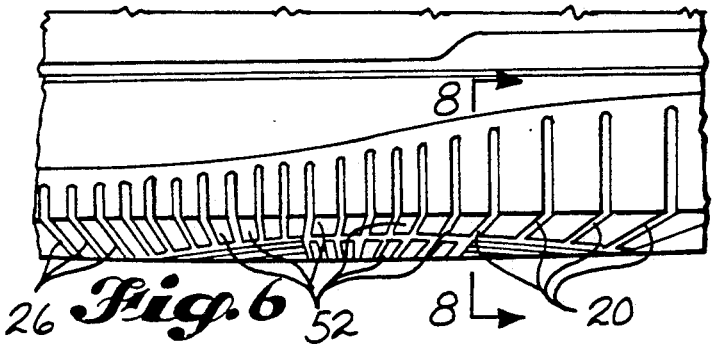
Fig. 6
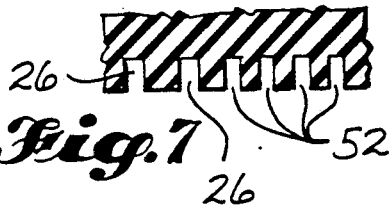
Fig. 7
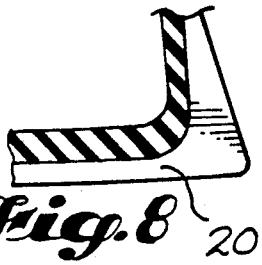
Fig. 8

SHOE SOLE WITH TWIST FLEX FEATURE

DESCRIPTION

1. Technical Field

This invention relates to shoes. More particularly, it relates to an athletic shoe comprising a sole having a twist flex portion generally below the ball region of the user's foot, for facilitating twisting of the sole in this region of the sole.

2. Background Art

Some sports require the participants to move forwards, backwards, laterally and diagonally, quickly and with ease. Some of these movements could be facilitated if the participant's shoe sole would readily flex in response to a twisting movement of the foot. Tennis is an example of a sport in which during the play of the game the players frequently change directions by a twisting action of the foot. It is a principal object of the present invention to provide an athletic shoe having a twist flex capability while still providing comfort and good traction.

3. Disclosure of the Invention

An athletic shoe constructed according to the invention is basically characterized by a sole which presents a surface contacting bottom having a toe portion, a heel portion, an arch portion forwardly of the heel portion, and a twist flex portion between the arch portion and the toe portion, generally below the ball region of the user's foot. According to the invention, the twist flex portion comprises a first set of spaced apart diagonal grooves in the bottom of the sole extending both laterally and rearwardly at least part way across the sole from the lateral side of the sole to the medial side of the sole, and a second set of spaced apart diagonal grooves extending both laterally and rearwardly at least part way across the sole from the medial side of the sole to the outside of the sole. The grooves reduce the thickness of the sole bottom at their locations and render the sole easier to bend at the locations of the grooves in the direction perpendicular to the grooves. The diagonal orientation of the first and second sets of grooves facilitates twisting of the sole bottom in the twist flex region of the sole.

Preferably, the toe portion of the sole includes a pivot ball. The twist flex portion may extend into and truncate the pivot ball and provide the pivot ball with a pair of rear edges which are intersecting chords and are defined by intersecting diagonal grooves at the forward boundary of the twist flex portion. The pivot ball otherwise has a circular plan form and presents a downwardly directed convex surface having a pivot center.

Preferably, the twist flex section includes an inner region in which the two sets of diagonal grooves intersect each other and define between them tread cleats, at least some of which have a diamond shape.

In preferred form, the sole includes an outer edge region that is defined on its lateral side by the outer boundary of the sole and on its inside by an arcuate groove which is spaced inwardly from the lateral side boundary of the sole and has generally the same curvature. The sole may include a mid region positioned laterally between the inner region and the outer region. Such mid region includes a plurality of spaced apart arcuate grooves and ribs between the grooves, which extend longitudinally of the sole and approximate in curvature the curvature of the lateral side boundary of the shoe.

In preferred form, the heel region of the sole comprises a pivot ball presenting a downwardly directed convex surface having a pivot center, and side portions flanking the pivot ball, said side portions having bottom surfaces spaced above the pivot ball.

Other features, advantages and objects of the invention are hereinafter described in the detailed description of the illustrated embodiment.

BRIEF DESCRIPTION OF THE DRAWING

In the drawings like reference numerals are used to designate like parts throughout the several views of the drawing, and:

FIG. 2 is a cross sectional view taken substantially along line 2—2 of FIG. 1;

FIG. 3 is a cross sectional view taken substantially along line 3—3 of FIG. 1;

FIG. 4 is a sectional view taken substantially along line 4—4 of FIG. 1;

FIG. 5 is a sectional view taken substantially along line 5—5 of FIG. 1;

FIG. 6 is a fragmentary elevational view taken from the aspect of line 6—6 in FIG. 2;

FIG. 7 is a fragmentary sectional view taken substantially along line 7—7 of FIG. 1; and FIG. 8 is an enlarged scale fragmentary sectional view taken substantially along line 8—8 of FIG. 6.

BEST MODE FOR CARRYING OUT THE INVENTION

Figure 1:
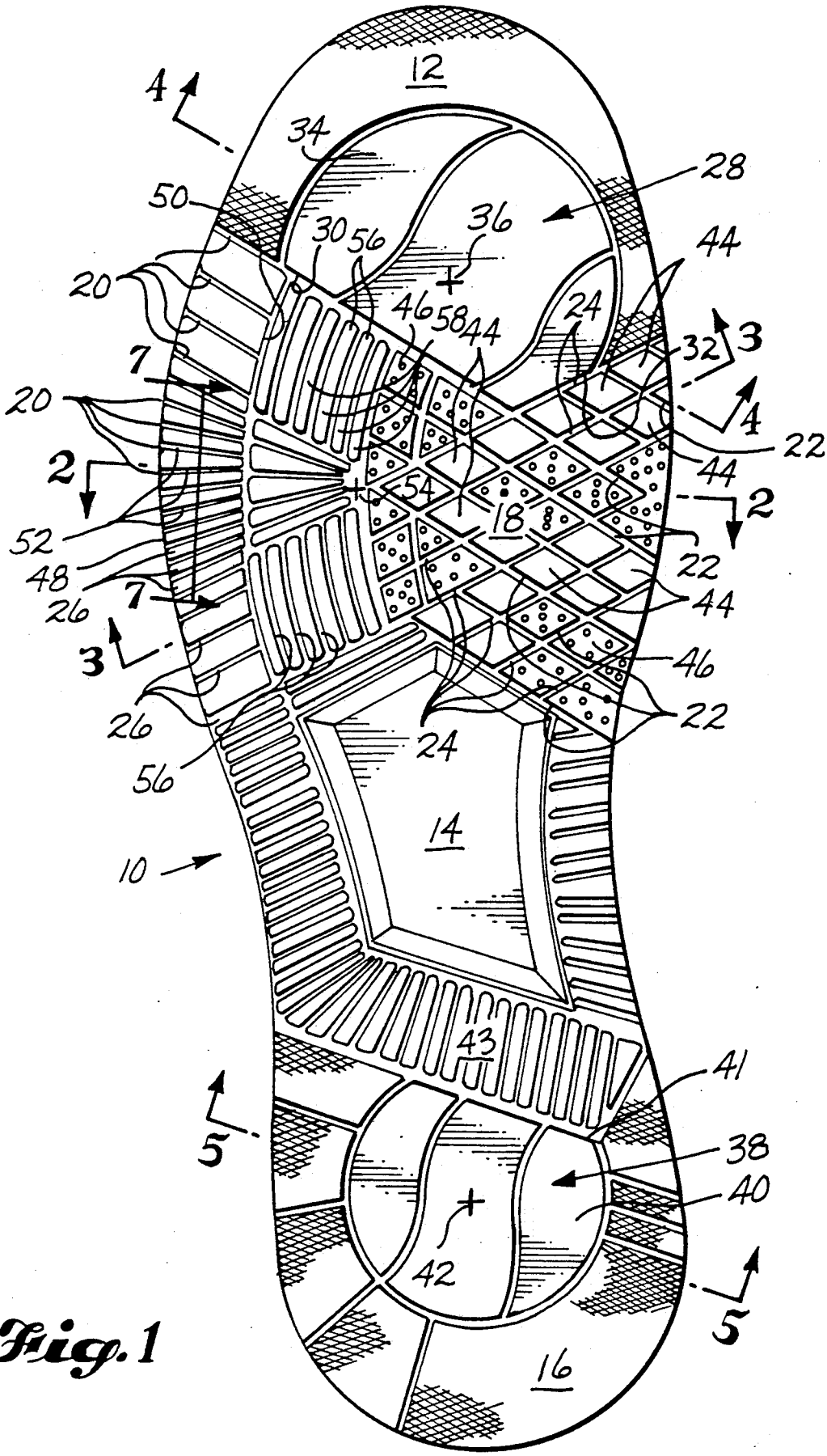
FIG. 1 is a plan view of a shoe sole which embodies the invention.

Referring to FIG. 1, the sole 10 that is illustrated is shown to comprise a toe portion 12, an arch portion 14 forwardly of a heel portion 16, and a twist flex portion 18. The twist flex portion is positioned between the arch portion 14 and the toe portion 12, generally below the ball region of the user's foot.

The twist flex portion 18 comprises a first set of spaced apart diagonal grooves in the bottom of the sole 10 which extend both transversely and rearwardly across the sole 10 from the lateral side of the sole 10 to the medial side of the sole 10. In the illustrated embodiment these grooves are designated 20 and 22. The flex portion 18 also comprises a second set of spaced apart diagonal grooves which also extend transversely and rearwardly across the sole 10 from the medial side of the sole 10 to the lateral side of the sole 10. In the illustrated embodiment these grooves are designated 24 and 26. As best shown by FIGS. 7 and 8, the grooves 20, 22, 24, 26 reduce the thickness of the sole bottom at their locations and render the sole 10 easier to bend at the locations of the grooves 20, 22, 24, 26 in a direction perpendicular to the grooves 20, 22, 24, 26. The diagonal orientation of the first and second sets of grooves facilitates twisting of the sole bottom in the twist flex region of the sole 10. As best shown by FIGS. 1 and 5, the reduced thickness of the sole bottom along intersecting diagonal lines is not continued forwardly into the toe portion of the sole. Thus, the twist flex action is not a part of the toe portion. The omission of the diagonal grooves from the toe portion gives the toe portion what may be referred to as pivot facilitating stiffness.

As shown by FIG. 2, the sole bottom is transversely convex in the twist flex region 18. FIGS. 4 and 5 show that the sole bottom is also transversely convex in the toe and heel regions 12, 16. Accordingly, the user can roll the shoe from side to side with relative ease. In preferred form, the toe portion 12 is constructed to include a pivot ball 28 which may be a truncated ball, as illustrated. As shown by FIG. 1, the twist flex portion 18 extends into and truncates the pivot ball 28. This provides the pivot ball with a pair of rear edges 30, 32 which are intersecting chords and which are defined by intersecting diagonal grooves 20, 24. The pivot ball 28 otherwise has a circular plan form. Pivot ball 28 presents a downwardly directed convex surface 34 having a pivot center 36. The user can pivot rather freely on the pivot ball 28 when his weight is forwardly on the toe portion 12. The portion of the shoe rearwardly of the pivot ball 28 is raised somewhat above the support surface into a position where it will not interfere with the pivotal movement. The above described elimination of diagonal grooves from the toe portion, and the inclusion in the toe portion of a downwardly directed surface on which the user can rather freely pivot when his weight is forwardly on the toe portion 12, provides the toe portion with what may be referred to as a pivot facilitating lower surface.

Preferably also, the heel region 16 is formed to include a pivot ball 38. Pivot ball 38 presents a downwardly directed convex surface 40 which has a pivot center 42. The user can pivot relatively freely on the pivot ball 38 when his weight is back on his heel. The portion of the sole bottom forwardly of the pivot ball 38 is raised above the support surface a sufficient amount that it will not interfere with pivotal movement on the ball 38.

As clearly shown by FIG. 1, the shoe sole includes an inner region defined by and between the intersecting diagonal grooves 22, 24. Tread cleats 44, 46 are defined in this region. These tread cleats 44, 46 have a generally diamond shape (full or partial). The cleats 46 may be raised somewhat above the cleats 44 as a way of controlling the amount of cleat area that is presented against the supporting surface. As will be appreciated, the amount of contacting cleat area can be varied substantially by varying the number and pattern of the cleats 46 which are raised. In the illustrated embodiment, all of the cleats 44 are identified. All of the remaining cleats are the longer cleats 46. Only some of them are referenced.

As also shown by FIG. 1, the sole includes an outer region that is defined on its outside by the lateral side boundary 48. This outer edge region is defined at its inside by an arcuate groove 50 which extends longitudinally of the sole and approximates in curvature the curvature of the lateral side boundary 48. The diagonal grooves 20, 26 extend transversely of the outer edge region. This region also includes grooves 52 situated between the sections which include the grooves 20 and 26. Grooves 52 extend generally radially from a point 54. The grooves 20, 26, 52 allow the outer edge region of the sole to flex relatively easily in a direction longitudinally of the sole. Transversely the outer edge region of the sole is relatively stiff.

The illustrated embodiment also includes a mid region 56 positioned transversely between the inner region and the outer edge region. The mid region includes a plurality of spaced apart grooves 56 which extend longitudinally of the sole and approximate in curvature the curvature of the lateral side boundary of the sole. Longitudinal ribs 58 are defined between the grooves 56.

The center portion of the mid region may be constructed to include a plurality of grooves radiating from point 54 and generally triangular cleats between the grooves. As will be apparent, the longitudinal ribs in the front and rear sections of the mid region interrupt the diagonal grooves and make flexing more difficult in these sections. The middle section of the mid region provides a substantial continuation of the grooves and thus maximizes the flexing in this area of the shoe sole. As will be appreciated, the pattern and extent of the longitudinal arcuate grooves and ribs can be used for controlling the flexing action.

The facilitation of a twist flex action is maximized in the region defined by the two sets of intersecting diagonal grooves. In the illustrated embodiment, this region has been referred to as the inner region of the shoe.

Generally speaking, the shoe sole will bend more easily in a direction perpendicular to a groove than it will longitudinally of the groove. Accordingly, the forward portion of the heel region can bend or flex more readily in the transverse direction than it can in the longitudinal direction. The side regions of the arch portion of the shoe sole can bend more easily in the longitudinal direction than in the transverse direction. In this context, "longitudinal" means "longitudinally of the shoe," "Transverse" means transversely of the shoe.

As will be appreciated, the degree of transverse and longitudinal bending of the sole can be controlled by the pattern of grooves and ribs and cleats between the grooves. In similar fashion, the twist flex capability of the shoe can be varied by increasing or decreasing the amount of intersecting diagonal grooves and the use and placement of longitudinal arcuate grooves and ribs in the twist flex section of the sole.

The illustrated embodiment is presented by way of example. The invention is not to be limited by this specific example but rather, is to be determined by the claims which follow, interpreted in accordance with established rules of patent claim interpretation, including use of the doctrine of equivalents.

What is claimed is:

1. A shoe, comprising:

a sole presenting a surface contacting bottom having a toe portion, a heel portion, an arch portion forwardly of the heel portion, and a twist flex portion between the arch portion and the toe portion, generally below the ball region of the user's foot, said toe portion having pivot facilitating stiffness and a pivot facilitating lower surface, said twist flex portion comprising a first set of spaced apart, diagonal grooves in the bottom of the sole extending both transversely and rearwardly at least part way across the sole from the lateral side of the sole to the medial side of the sole, and a second set of spaced apart diagonal grooves extending both transversely and rearwardly at least part way across the sole from the medial side of the sole to the lateral side of the sole, said grooves reducing the thickness of the sole bottom at their locations rendering the sole easier to bend at the locations of the grooves in a direction perpendicular to the grooves, with the diagonal orientation of the first and second sets of grooves facilitating twisting of the sole bottom in the twist flex portion of the sole, said twist flex portion having a forward boundary defined by a crossing pair of forward most diagonal grooves, one from each of said first and second sets of diagonal grooves, with the intersection of said forward most grooves located adjacent where the user's toes meet the user's ball region of the foot, and a truncated pivot ball in the toe portion of the sole, said twist flex portion extending into and truncating the pivot ball and providing the pivot ball with a pair of rear edges which are on intersecting chords and are defined by the intersecting diagonal grooves forming the forward boundary of the twist flex portion, said pivot ball otherwise having a substantially circular plan form and presenting a downwardly directed convex surface having a pivot center.

2. A shoe according to claim 1, wherein the twist flex portion includes an inner portion in which the two sets of diagonal grooves intersect each other and define between them tread cleats, some of which have their contact surfaces raised relative to the contact surfaces of others, and at least some of which have a diamond shape.

3. A shoe according to claim 2, wherein said sole includes an outer edge portion that is defined on its outside by the lateral side boundary of the sole, and at its inside by an arcuate groove which is spaced inwardly from the lateral side boundary of the sole and has generally the same curvature, said outer edge portion being segmented by grooves which extend generally radially.

4. A shoe according to claim 3, wherein the sole includes a mid portion positioned transversely between said inner portion and said outer edge portion, said mid portion including a plurality of spaced apart arcuate grooves which extend longitudinally of the sole and approximate in curvature the curvature of the lateral side boundary of the shoe.

5. The shoe according to claim 1, wherein said heel portion of the sole comprises a pivot ball presenting a downwardly directed convex surface having a pivot center, and side portions flanking the pivot ball, said side portions having bottom surfaces spaced above the pivot center.

6. A shoe according to claim 1, wherein the twist flex portion includes an inner portion in which the two sets of diagonal grooves intersect each other and define between them tread cleats, some of which have their contact surfaces raised relative to the contact surfaces of others, and at least some of which have a diamond shape.

7. A shoe according to claim 6, wherein said sole includes an outer edge portion that is defined on its outside by the lateral side boundary of the sole and at its inside by an arcuate groove which is spaced inwardly from the lateral side boundary of the sole and has generally the same curvature, said outer edge portion being segmented by grooves which extend generally radially.

8. A shoe according to claim 1, wherein said sole includes an outer edge portion that is defined on its outside by the lateral side boundary of the sole and at its inside by an arcuate groove which is spaced inwardly from the lateral side boundary of the sole and has generally the same curvature, said outer edge portion being segmented by grooves which extend generally radially.

9. A shoe comprising:

a sole presenting a surface contacting bottom having a toe portion, a heel portion, an arch portion forwardly of the heel portion, and a twist flex portion between the arch portion and the toe portion, generally below the ball region of the user's foot, said toe portion having pivot facilitating stiffness and a pivot facilitating lower surface, said twist flex portion comprising a first set of spaced apart, diagonal grooves in the bottom of the sole extending both transversely and rearwardly at least part way across the sole from the lateral side of the sole to the medial side of the sole, and a second set of spaced apart diagonal grooves extending both transversely and rearwardly at least part way across the sole from the medial side of the sole to the lateral side of the sole, said grooves reducing the thickness of the sole bottom at their locations rendering the sole easier to bend at the locations of the grooves in a direction perpendicular to the grooves, with the diagonal orientation of the first and second sets of grooves facilitating twisting of the sole bottom in the twist flex portion of the sole, said twist flex portion having a forward boundary defined by a crossing pair of forward most diagonal grooves, one from each of said first and second sets of diagonal grooves, with the intersection of said forward most grooves located adjacent where the user's toes meet the user's ball region of the foot, and a truncated pivot ball in the tow portion of the sole, said twist flex portion extending into and truncating the pivot ball and providing the pivot ball with a pair of rear edges which are on intersecting chords and are defined by the intersecting diagonal grooves forming the forward boundary of the twist flex portion, said pivot ball otherwise having a substantially circular plan form and presenting a downwardly directed convex surface having a pivot center; and said heel portion of the sole comprises a pivot ball presenting a downwardly directed convex surface having a pivot center, and side portions flanking the pivot ball, said side portions having bottom surfaces spaced above the pivot center.

10. A shoe according to claim 9 wherein the twist flex portion includes an inner portion in which the two sets of diagonal grooves intersect each other and define between them tread cleats, some of which have their contact surfaces raised relative to the contact surfaces of others, and at least some of which have a diamond shape.

11. A shoe according to claim 10, wherein said sole includes an outer edge portion that is defined on its outside by the lateral side boundary of the sole and at its inside by an arcuate groove which is spaced inwardly from the lateral side boundary of the sole and has generally the same curvature, said outer edge portion being segmented by grooves which extend generally radially.

12. A shoe according to claim 11, wherein the sole includes a mid portion positioned transversely between said inner portion and said outer edge portion, said mid portion including a plurality of spaced apart arcuate grooves which extend longitudinally of the sole and approximate in curvature the curvature of the lateral side boundary of the shoe.

13. A shoe, comprising:

a sole presenting a surface contacting bottom having a toe portion, a heel portion, an arch portion forwardly of the heel portion, and a twist flex portion between the arch portion and the toe portion, generally below the ball region of the user's foot, said toe portion having pivot facilitating stiffness and a pivot facilitating lower surface, said twist flex portion comprising a first set of spaced apart, diagonal grooves in the bottom of the sole extending both transversely and rearwardly at least part way across the sole from the lateral side of the sole to the medial side of the sole, and a second set of spaced apart diagonal grooves extending both transversely and rearwardly at least part way across the sole from the medial side of the sole to the lateral side of the sole, said twist flex portion having a forward boundary defined by a crossing pair of forward most diagonal grooves, one from each of said first and second sets of diagonal grooves, with the intersection of said forward most grooves located adjacent where the user's toes meet the user's ball region of the foot, said grooves reducing the thickness of the sole bottom at their locations rendering the sole easier to bend at the locations of the grooves in a direction perpendicular to the grooves, with the diagonal orientation of the first and second sets of grooves facilitating twisting of the sole bottom in the twist flex portion of the sole; and said twist flex portion includes an inner portion in which the two sets of diagonal grooves intersect each other and define between them tread cleats, some of which have their contact surfaces raised relative to the contact surfaces of others, and at least some of which have a diamond shape; and said sole includes an outer edge portion that is defined on its outside by the lateral side boundary of the sole and at its inside by an arcuate groove which is spaced inwardly from the lateral side boundary of the sole and has generally the same curvature, said outer edge portion being segmented by grooves which extend generally radially; and further including a mid portion positioned transversely between said inner portion and said outer edge portion, said mid portion including a plurality of spaced apart arcuate grooves which extend longitudinally of the sole and approximate in curvature the curvature of the lateral side boundary of the shoe.

* * * * *